United States Patent [19]

Walulik

[11] Patent Number: 4,485,870

[45] Date of Patent: Dec. 4, 1984

[54] METHOD AND APPARATUS FOR CONDUCTING WIRELINE OPERATIONS IN A BOREHOLE

[75] Inventor: James J. Walulik, Houston, Tex.

[73] Assignee: Schlumberger Technology Corporation, Houston, Tex.

[21] Appl. No.: 460,340

[22] Filed: Jan. 24, 1983

[51] Int. Cl.[3] ..... E21B 23/08; E21B 43/11; E21B 47/00

[52] U.S. Cl. ..... 166/250; 166/55; 166/65 R; 166/297; 166/383

[58] Field of Search ..... 166/250, 297, 55, 65 R, 166/383, 384, 55.1, 298, 254, 253, 255, 153, 385

[56] References Cited

U.S. PATENT DOCUMENTS 3,467,196 9/1969 Kingman ..... 166/383
3,727,693 4/1973 Tausch et al. ..... 166/77
3,957,119 5/1976 Yonker ..... 166/383
4,349,072 9/1982 Escaron et al. ..... 166/250

*Primary Examiner*—Stephen J. Novosad
*Assistant Examiner*—William P. Neuder

[57] ABSTRACT

For conducting wireline operations in a deviated borehole, a dual or two-stage locomotive pulls a wireline cable through both the entire length of a drill string and the entire length of a stinger therein to dock with a tool at the bottom of the stinger. The inner or second-stage locomotive then pulls the stinger out into the borehole by pushing on the bottom end of the stinger to prevent buckling the stinger. The stinger and drill stem can be assembled to virtually any length, without requiring pre-wiring. The risk of buckling upon retracting the stinger back into the drill pipe, by pulling on the cable, is reduced by the use of the special configuration provided by the present invention.

6 Claims, 8 Drawing Figures

METHOD AND APPARATUS FOR CONDUCTING WIRELINE OPERATIONS IN A BOREHOLE

CROSS REFERENCE TO RELATED APPLICATIONS

Reference is made to co-pending U.S. patent application Ser. Nos. 310,830, filed Oct. 13, 1981, and entitled "Pump-Down Stinger Assembly Method and Apparatus" and 460,394, filed concurrently herewith and entitled "Method and Apparatus for Conducting Wireline Operations in a Borehole." Both applications are assigned to the Assignee of the present invention.

BACKGROUND OF THE INVENTION

The present invention relates to wireline borehole operations, particularly borehole logging and perforating operations using a stinger for extending, moving, and positioning wireline tools in highly deviated wells.

In the ever continuing search for oil and gas, as well as the development of oil and gas fields for production, more and more wells are being drilled today with significant portions of the borehole deviating substantially from the more traditional vertical orientation. In offshore production, for example, it is usually more economical to have a single drilling and production platform serving a large number of wells than to have individual platforms for each well. Accordingly, many of the boreholes drilled from such a shared or common platform must travel substantial horizontal distances to reach the region of the reservoir intended to be logged or produced. Other conditions calling for highly deviated boreholes include shallow depth gas production, exploration and production under shipping fareways, and special circumstances imposed by deed restrictions or by governmental agencies on surface production facilities in certain areas. Such boreholes have increasingly long, highly deviated ramps, often above 70° angles of deviation and lengths of 16,000 feet or more.

To determine various physical parameters of the formations adjacent the borehole, and to perforate borehole for production, traditional and conventional well-logging tools and peforators are commonly suspended and lowered into the borehole on a well-logging cable (a "wireline") to the area under consideration. In such highly deviated boreholes, however, gravity cannot be relied upon to lower the well logging tool and to pull the wireline cable along behind the tool.

Another technique for moving subsurface well equipment, particularly when pipe or tubing is available in the well, is to pump the equipment through the tubing by fluid flow therein. U.S. Pat. No. 3,727,693 (issued Apr. 17, 1973 to Tausch et al), for example, shows a two-stage locomotive system for moving well equipment through a curved entrance tubing into a well. The equipment is pushed ahead of the locomotives through tubing which is itself stationary. Such systems have utility for self-contained well equipment, but, due to the "capstan" effect in the curved tubing at the well entrance, they are not usually effective with wireline tools because of the tremendous forces necessary to pull cables through and around this curved entrance portion.

Thus, as explained more fully in U.S. Pat. Nos. 4,337,969 (issued July 6, 1982) and 4,349,072 (issued Sept. 14, 1982), both assigned to the Assignee of the present invention, it has been proposed to move conventional wireline tools through a deviated borehole by use of an extension member (a "stinger") affixed to the well-logging tool and movable into and out of the lower end of a pipe, such as drill pipe, in which it is carried to the borehole region of interest. As further described in these patents, the stinger then provides for pushing and pulling the well logging tool through this borehole region as desired.

A number of challenges, however, are associated with this technique. Principle among them is making the electrical connections between the logging tool in the borehole, the surface equipment at the top of the borehole, and the cable in between. It is impractical to attempt to feed the cable into the drill pipe as the drill pipe is added to the drill string one section at a time at the surface. One prior art solution was to attach the wireline to the outside of the drill pipe as the drill string was being assembled. Attaching the cable to the outside of the drill pipe, however, exposes it to a substantial risk of damage and abrasion as it is then moved through the borehole.

Another solution, as described in the above-noted '969 patent, is to secure the cable to the outside of the stinger, but pass the cable which is above the stinger through the inside of the drill pipe. This provides additional protection for the cable, but still does not enclose it fully all the way to the tool.

The above-noted '072 patent discloses another very successful method and apparatus for pulling the wireline cable through the drill pipe after the drill pipe has been assembled. A full-sized wireline tool (usually too big to pass through the drill string) is releasably attached to the bottom end of the drill string. A locomotive propelled by mud pressure in the drill string pulls both the wireline and the stinger through the drill string. The stinger then docks on the upper end of the wireline tool, to make the mechanical and electrical connections and to propel the tool out of the drill string and into the borehole on the end of the stinger. Again, this invention averts the need to install the wireline through the entire length of the drill string as it is being assembled. However, it is still necessary to provide the stinger, during assembly at the wellsite, with its own length of cable from end to end, which, in this case is installed inside the stinger where it is protected. Unfortunately, this latter feature makes it inconvenient to use stingers of substantial length, thus requiring a series of shorter logging operations over intervals of the length of the short stinger, rather than being able to conduct longer individual operations with a lengthly stinger. Perhaps an even greater factor limiting the practical length of the stinger is the risk that the stinger may buckle when being pushed out of the drill stem by the locomotive. The longer the stinger, the greater may be the necessary pushing force, and accordingly the greater the risk of buckling.

A need therefore remains for an apparatus and method for conducting logging or perforating operations in a highly-deviated well bore in which drill stems and stingers of practically and desired length can be assembled and used without requiring that they be "prewired" or otherwise furnished with a wireline cable, in which the wireline cable can be furnished to the logging tool through the drill stem and stinger to protect the cable from damage in the borehole, and in which the stinger is effectively pulled out from the drill pipe so that, regardless of the length of the stinger, it is essentially protected against buckling.

SUMMARY OF THE INVENTION

Briefly, the present invention meets the above needs and purposes with a dual or two-stage locomotive which is capable of pulling a wireline cable through the entire length of both the drill string and the stinger after they have been fully assembled and placed in the borehole, with a full-sized tool attached to them at the bottom. Further, when the logging operations is to be conducted, the two-stage locomotive system also basically pulls (rather than pushes) the stinger out into the borehole from the bottom end of the stinger, so that the risk of buckling is virtually eliminated. The entire stinger and drill stem can therefore be assembled to virtually any length, without requiring any prewiring, thereby avoiding the attendant expense and/or inconvenience and delay of prior art methods and apparatus. Also, upon retracting the stinger back into the drill pipe, even though the cable pulls from the tool at the very bottom of the stinger, the special configuration provided by the present invention still effectively prevents the stinger from buckling.

It is therefore an object of the present invention to provide a new and improved apparatus and method for use in conjunction with pipe, such as drill pipe, for logging and/or performing earth formations surrounding a borehole; in which a stinger tubing of virtually unlimited length may be employed in conjunction with the pipe without risk of buckling; in which the tubing and pipe may be assembled in an un-wired configuration; in which a wireline may subsequently be conveyed through the pipe and stinger tubing and electrically and mechanically coupled to a wireline tool on the bottom of the stinger; in which a dual locomotive system may be employed to perform these functions; and to accomplish the above objects and purposes in an inexpensive, versatile, reliable, and highly effective method and apparatus particularly well suited for logging and perforating highly deviated boreholes.

Other objects and advantages of the invention will be apparent from the following description, the accompanying drawings, and the appended claims.

DESCRIPTION OF THE PREFERRED EMBODIMENT

Figure 1:
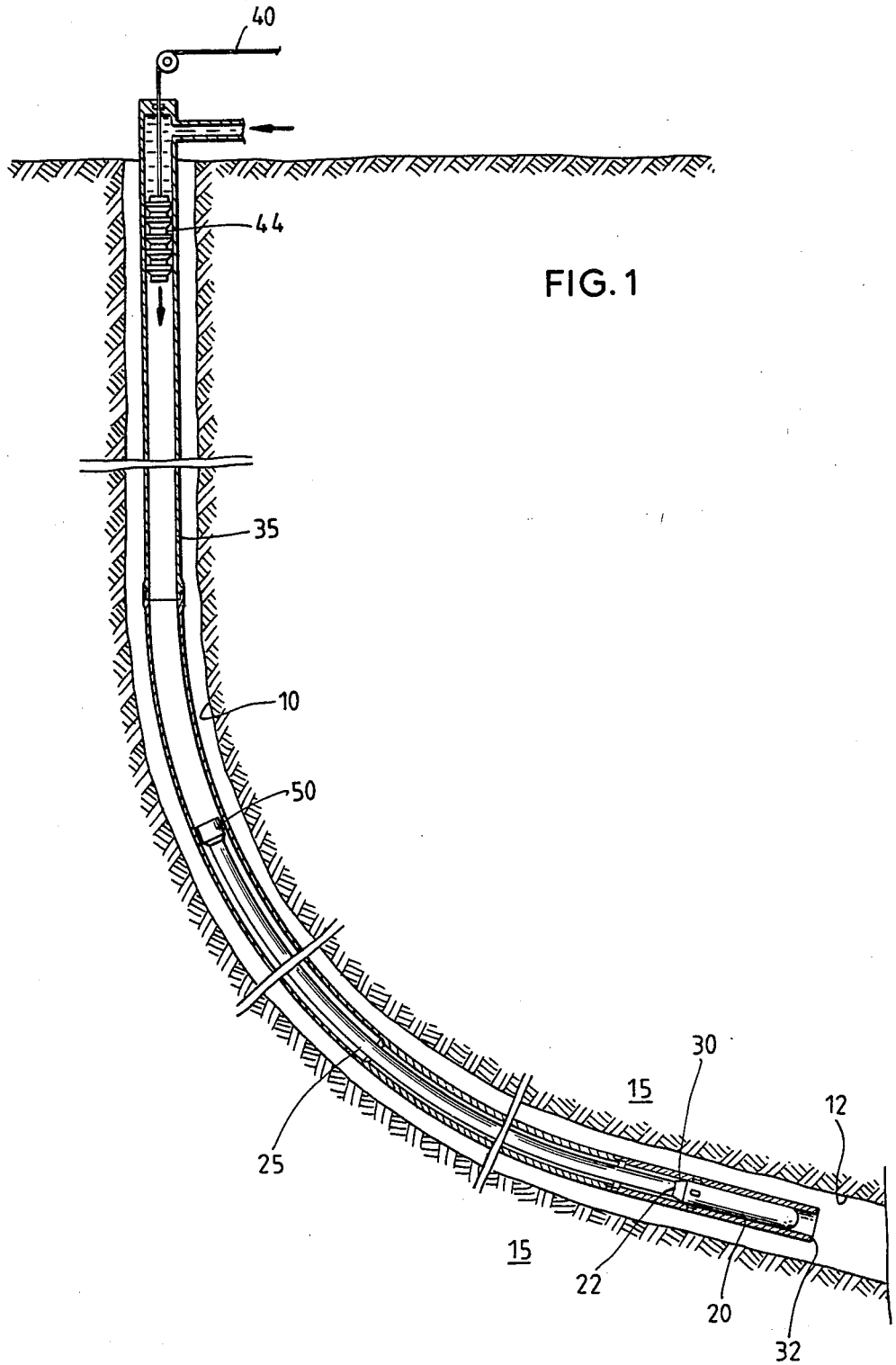
FIG. 1 figuratively illustrates a deviated borehole tranversing earth formations to be logged, using a drill string, stinger, and logging tool shown already made up and disposed therein, and also showing the dual locomotive just entering the drill string.
Figure 2:
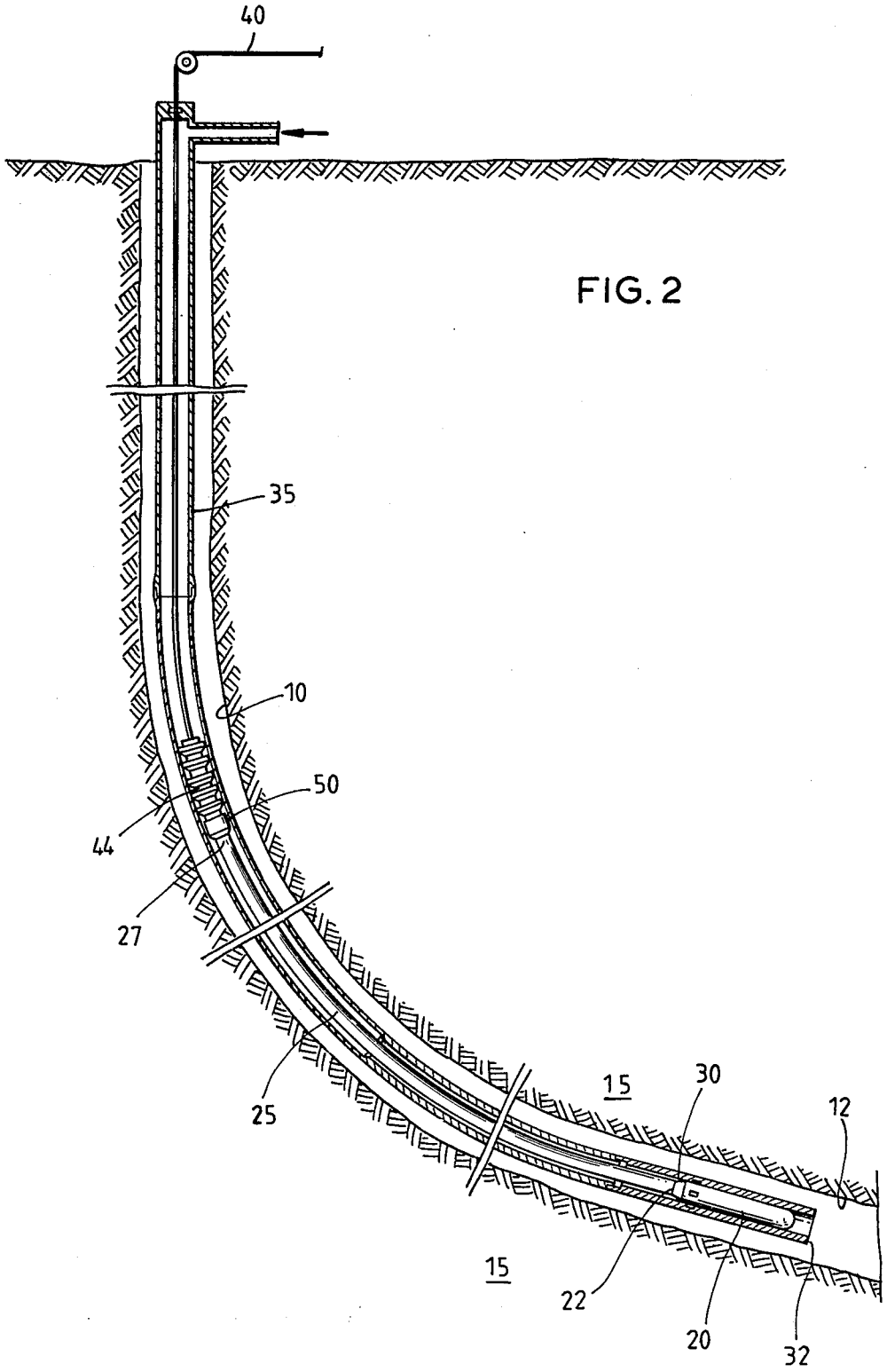
FIG. 2 shows the dual locomotive docking with the upper end of the stinger.
Figure 3:
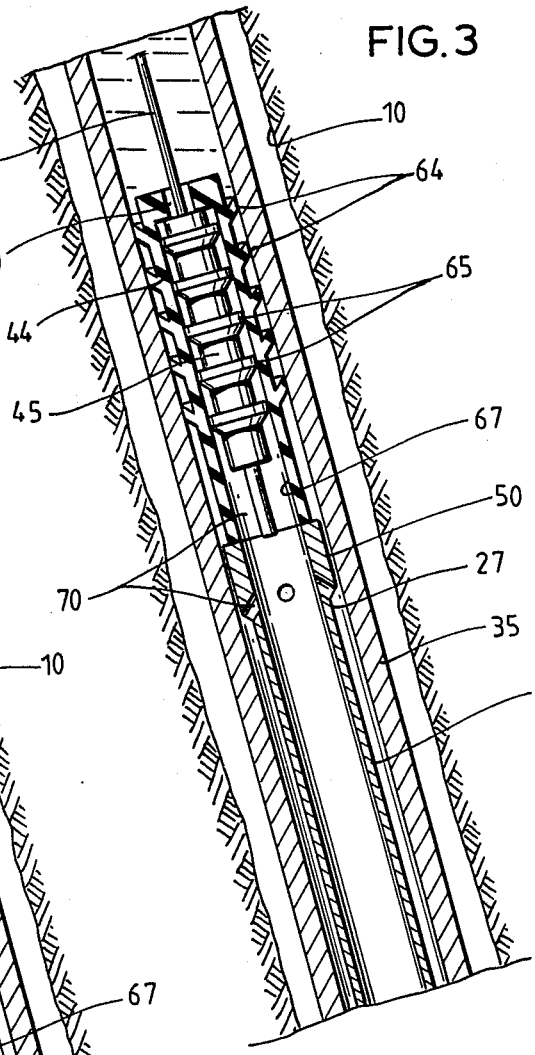
FIG. 3 is a detailed, partially cross-sectioned view of the locomotive docked with the stinger in the position shown in FIG. 2.

With reference to the drawings, the new and improved apparatus for logging or perforating earth formations surrounding a borehole, particularly a highly deviated borehole, and the method therefor according to the present invention, will be described. FIG. 1 shows a borehole 10 having a highly deviated portion 12 transversing earth formations 15. In order to perform the desired logging or perforating operations in the interval of interest in the deviated portion 12, a conventional wireline tool 20 is shown mounted on the lower end 22 of a hollow extension member or stinger 25, opposite the upper end 27 thereof. As will be more fully described hereinafter, tool 20 is in fact attached to and supported by a docking head 30 at the end 22 of stinger 25. Docking head 30, in turn, is releasably latched to the lower end 32 of a length of drill pipe 35 in which stinger 25 is extendably received for transportation by drill pipe 35 to the deviated borehole portion 12 of interest.

As will be well understood by those skilled in the art, wireline tool 20 may be any conventional well-logging tool for logging earth formations surrounding borehole 10, or it may be a conventional well bore perforator, such as used during completion operations to perforate a cased borehole. It should therefore be understood that the term "wireline tool", as used herein, is with reference to any borehole tool typically coupled to the surface equipment, such as the conventional surface equipment designated generally by reference numeral 38, through a well logging communication cable 40 more commonly known as a "wireline".

The drill pipe 35 and stinger 25 may be assembled by any of the conventional means usually followed in deviated borehole operations employing a stinger carried within a drill pipe. Of significance to the pressent invention is the fact that the drill pipe and stinger, during and after their assembly and transportation to the deviated borehole portion 12, do not contain any lengths of wireline cable. Thus, the steps for furnishing a cable within a stinger section, such as disclosed in the above-noted '830 application, or the provision for a stinger which is pumped down from the surface with the cable following behind it, as in the above-noted '072 patent, are unnecessary. Likewise, the cable is not carried on the outside of the drill pipe or stinger where it might be exposed to abrasion and damage from contact with the borehole walls during the logging or perforating operation.

Instead, the present invention provides for bringing the wireline cable 40 to the wireline tool 20 and for extending the stinger 25 from the drill pipe 35 by means of a dual locomotive having a first locomotive portion 44 and a second locomotive portion 45.

More specifically, the hollow length of stinger tubing 25 is free for movement upwardly and downwardly within the drill pipe 35 since the stinger has an outside diameter smaller than the inside diameter of the drill pipe 35 in which the present invention is to be used. A first docking means 50 on the upper end 27 of stinger 25 is provided for receiving the first locomotive 44 thereon. While it is possible to provide for latching the first locomotive 44 and the first docking means 50 together, it will be seen, as the invention is further developed below, that this is not necessary, and that the first locomotive may simply seat upon the docking means 50.

A second docking means 55 is mounted on the lower end 22 of stinger 25. The second docking means 55, which may be of any known suitable configuration, is adapted for receiving and coupling to the second locomotive 45 after locomotive 45 has passed through the interior of the hollow stinger tubing 25. Docking means 55 is also adapted for making at least one electrical connection with the second locomotive 45 for completing the electrical circuit from the wireline cable 40 to the wireline tool 20. The attaching of the wireline tool 20 to the second docking means 55 at the lower end 22 of stinger 25 may be accomplished, for example, through the lower docking head 30 to which the tool 20 is secured. Docking head 30 and locomotive 45 each contain complementary wet matable connector portions 59*a* and *b*, of designs well known in the well logging art, for completing one or more of these electrical connections.

A releasable latching means 60, of any suitable electrically or mechanically actuated design known in the art, cooperatively latches the docking means 55 to the adjacent drill pipe 35, when docking means 55 is not coupled to second locomotive 45, to support the wireline tool 20 and stinger 25 within the lower end 32 of the drill pipe 35. Latching means 60 than also provides for releasing the second docking means 55 from the drill pipe 35 when coupled to locomotive 45.

The first locomotive 44 has a seal portion 64 which has an effective outside diameter substantially equal to the inside diameter of the drill pipe 35 in which it is to be used. As indicated, first locomotive 44 is also adapted for engaging the first docking means 50, and as will be further explained hereinbelow, is moved to docking means 50 by the pressure of fluid flow within and through the drill pipe 35. Likewise, the second locomotive 45 includes a seal portion 65 having an effective outside diameter substantially equal to the inside diameter of the stinger tubing 25. Second locomotive 45 is similarly adapted, therefore, to be propelled through the stinger tubing 25 by the pressure of fluid flow therethrough. In addition, first locomotive 44 contains a hollow recess 67 having a diameter substantially equal to the inside diameter of the stinger tubing 25, for receiving the second locomotive 45 therein and helping to propel locomotive 45 when positioned therein and within the drill pipe 35 before reaching the first docking means 50 on the upper end 27 of stinger 25. As may be seen from the drawings, therefore, second locomotive 45 is adapted for pulling the wireline cable 40 through the drill pipe 35, the first locomotive 44, and the stinger tubing 25, and for moving beneath and independently of the first locomotive 44 after locomotive 44 has docked upon the first docking means 50.

Figure 4:
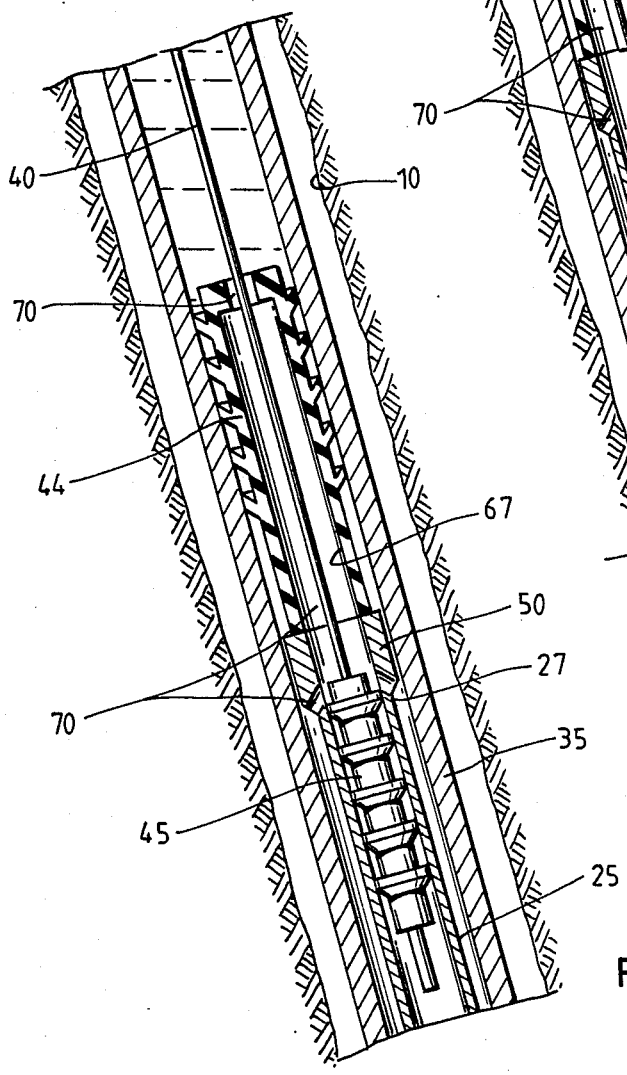
FIG. 4 is a view similar to FIG. 3 showing the inner locomotive separating from the outer locomotive and entering the stinger.
Figures 5, 6:
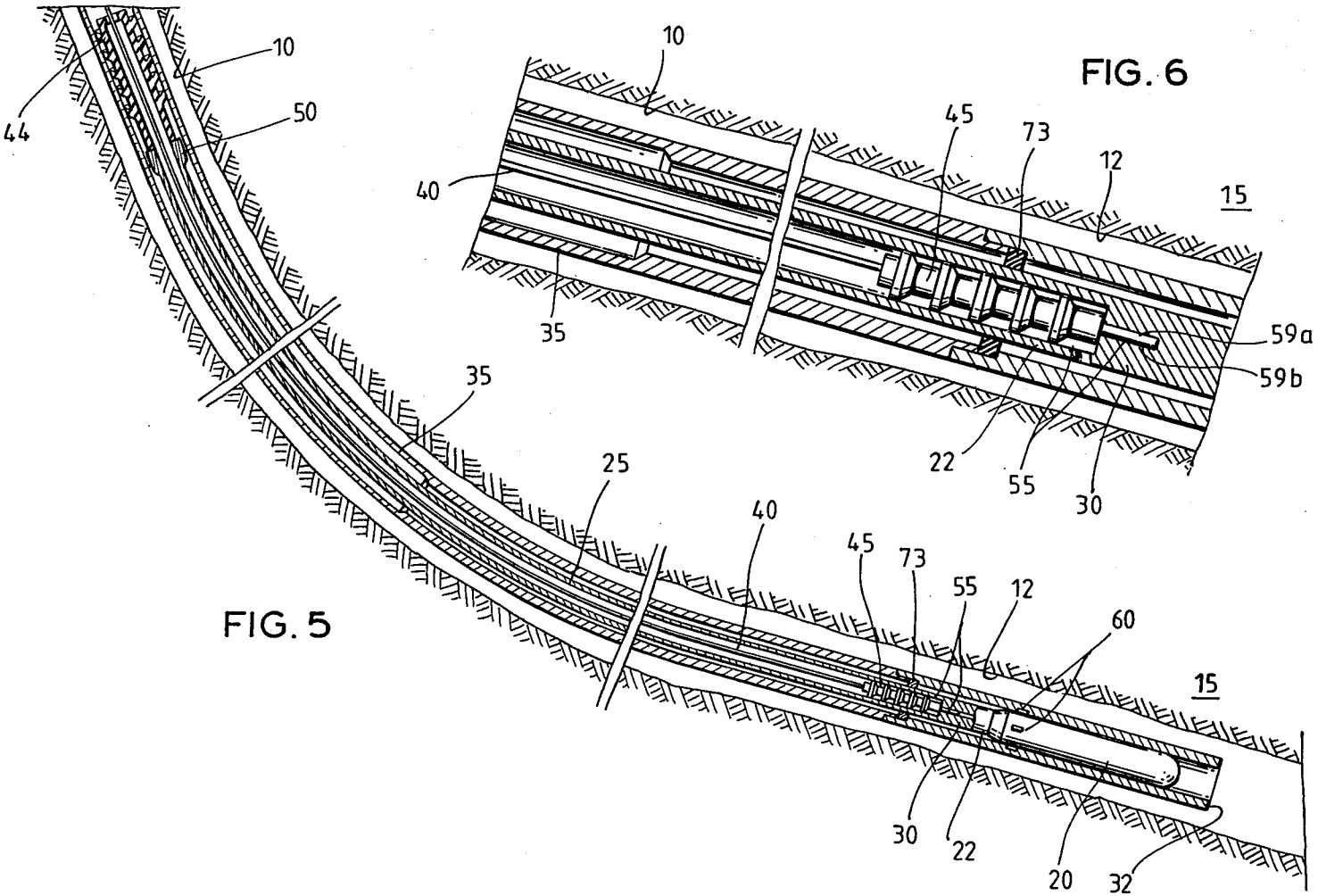
FIG. 5 is a view showing the inner locomotive just docking at the lower end of the stinger, and beginning to pull the stinger from the tubing.
FIG. 6 is a detailed, partially cross-sectioned view of the inner locomotive in the position shown in FIG. 5.
Figures 7, 8:
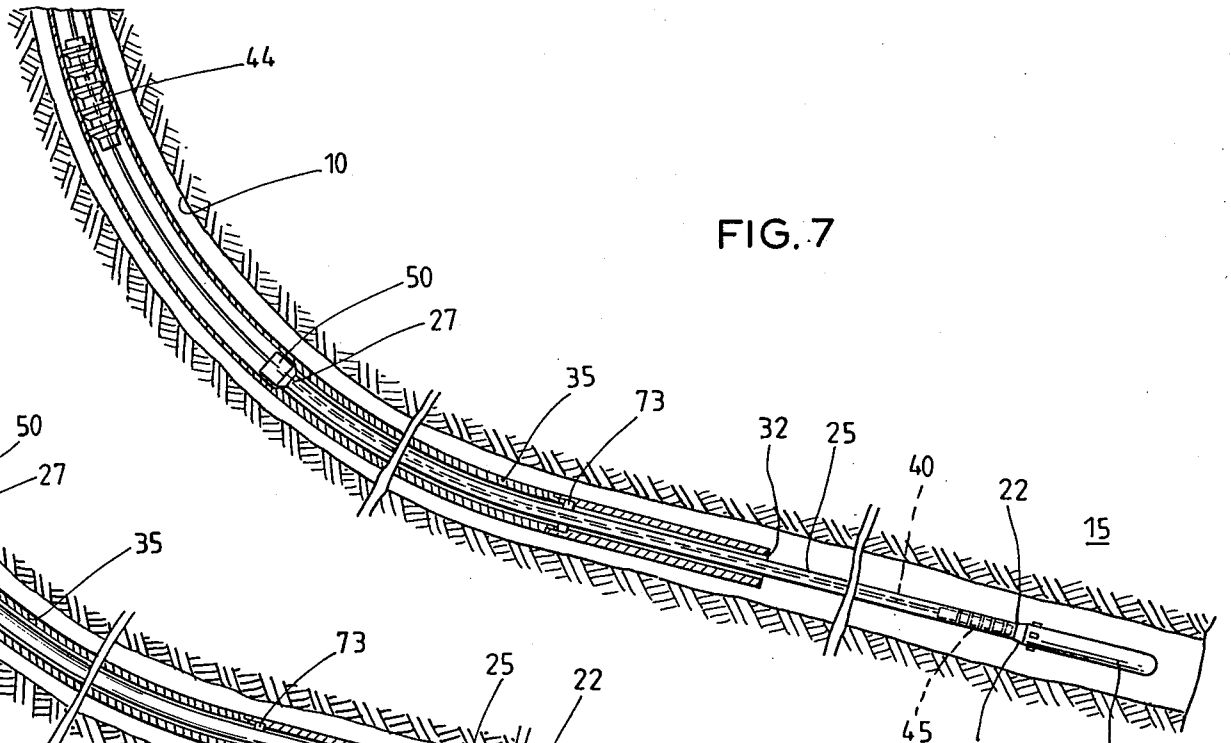
FIG. 7 shows the stinger fully extended.
FIG. 8 illustrates the tool and stinger partially retracted back into the drill string during a logging operation.

The first locomotive 44 contains a fluid passage 70 which is comprised, in part, of the hollow recess 67 so that the fluid passage 70 is closed when the second locomotive 45 is positioned therein for movement with the first locomotive 44. Otherwise, when hollow recess 67 is open, the fluid passage 70 fluidly couples entirely through the first locomotive 44, from each side of the seal portion 64, for conducting fluid therethrough and thereby equalizing the hydraulic pressures on each side of the locomotive 44. As may be seen in FIG. 4, this condition obtains especially when the first locomotive 44 is received upon the first docking means 50 at the upper end 27 of stinger 25. By equalizing the hydraulic pressures across the first locomotive 44 at this time, locomotive 44 provides essentially no pushing force or thrust upon the upper end 27 of stinger 25 as the stinger is being propelled out the end of the drill pipe 35. (The only pushing force, in fact, derives from the mud pressure upon the effective cross-sectional area of the upper end 27 of the stinger tubing 25.)

A stinger seal 73, below the first docking means 50 and preferably adjacent the lower end 32 of the drill pipe 35, movably seals the outside of the stinger tubing 25 to the inside of the drill pipe 35, to prevent fluid which is pumped into the drill pipe 35 from escaping around the outside of the stinger tubing 25. Instead, fluid pumped into the drill pipe will first propel both locomotives, starting from the upper end of the drill pipe 35 at the earth's surface, downwardly into the drill pipe until the first locomotive 44 reaches and seats upon the first docking means 50. At that time, the fluid pressure will continue propelling the second locomotive 45 downwardly through the inside of the stinger tubing 25 until the second locomotive reaches the second docking means 55.

Upon reaching the second docking means 55, locomotive 45 will actuate the latching means 60 to release the stinger tubing 25 from the drill pipe 35 and couple the second locomotive 45 simultaneously to the latching means 60. Further fluid flow through the drill pipe 35 then urges or propels the second locomotive 45 further downwardly and outwardly of the drill pipe 35, causing the locomotive 45, since it is located at the lower end 22 of stinger 25, to pull the entire length of the stinger thereabove out of the bottom of the drill pipe 35. That is, substantially all of the force moving the stinger 25 and wireline tool 20 out of the drill pipe 35 and into position for the logging operation is applied by the second locomotive 45 at the bottom of the stinger, and is therefore a pulling force insofar as most of the stinger length is concerned. The only force tending to push the stinger, as mentioned above, is the small force represented by the pressure on the effective cross-sectional area of the upper end 27 of the stinger tubing 25, due to the equalizing of the pressures across the first locomotive 44 by the fluid passage 70 therethrough.

After the wireline tool 20 and stinger 25 have been extended as desired, a conventional logging or perforating operation may be performed. In a logging operation, the wireline cable 40 will be retrieved to move the tool 20 to the positions and at the rates desired to perform the logging operation. This concurrently causes the stinger 25 to be retrieved or retracted into the drill pipe 35. The retrieving force is furnished by the pull and retracting of the wireline cable 40. As will be appreciated, the stinger 25 at this time is being pushed back into the drill pipe 35 by the second locomotive 45 at the lower end 22 of stinger 25. However, the stinger 25 is again protected by the present invention from buckling. That is, any tendency of the stinger 25 to buckle will result in the application of a lateral force to the wireline cable 40. Such a force will serve only to further increase the tension on cable 40, which will not allow the stinger 25 to buckle. Since the deviation from "straight" at this point is but very slight, only a very small lateral force is necessary to withstand tremendous longitudinal forces in the stinger to prevent it from buckling.

That is an important feature of the present invention, and although not readily apparent, can be easily demonstrated by slipping a piece of string through a small diameter rubber tube, securing the string to one end, and pulling the string through the tubing from the other end. It will be seen that the tubing cannot be buckled by even very considerable pulling forces applied by the string since the tension on the string far exceeds the net lateral buckling forces applied to the tubing. Thus, the present invention provides for the use of stingers 25 of practically unlimited length, and these can be extended and retracted without concern for buckling thereof.

After the operation is completed, the second locomotive is uncoupled from the stinger tubing 25. Further retraction of the wireline cable 40 then pulls the second locomotive into the hollow recess 67 of first locomotive 44 causing locomotive 44 to be pushed upwardly by locomotive 45 as the latter is pulled upwardly by the wireline cable 40 attached to it. The dual locomotives and wireline cable are thus fully retracted and removed from the stinger tubing and drill pipe to provide the maximum ease and convenience for subsequently repositioning the tool 20 by changing the length of the drill pipe 35, for adjusting the length of the stinger 25, or removing either or both from the borehole 10, as desired, without the necessity to accommodate a wireline cable.

As may be seen, therefore, the present invention has numerous advantages. Principally, it provides for convenient and rapid assembly of a stinger logging or pefo-rating tubing and drill pipe assembly of virtually unlimited length for use in logging highly deviated wells. Additionally, due to the unique configuration of the dual locomotive propulsion system, the stinger is extended from the tubing by being pulled therefrom rather than pushed, and retraction is by means of a tensioned cable within the tubing such that the risk of buckling the tubing is virtually eliminated regardless of the tubing length. Stingers of virtually any length can therefore be contemplated and readily accommodated by the present invention, and the wireline cable electrically connected to the wireline tool quickly, easily, with minimum expense, and in a manner which effectively shields the cable from exposure to any damage in the borehole.

While the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. Apparatus for use in conjunction with pipe such as drill pipe for logging or perforating earth formations surrounding a borehole, comprising:

(a) a hollow length of stinger tubing having upper and lower ends and an outside diameter smaller than the inside diameter of the intended drill pipe, (b) first docking means on the upper end of said stinger tubing adapted for receiving a locomotive thereon, (c) second docking means mounted on the lower end of said stinger tubing adapted for receiving and coupling a locomotive thereto through said stinger tubing, and for making at least one electrical connection therewith, (d) means for attaching a wireline tool to the lower end of said second docking means, (e) releasable latching means, mounted at least in part on said docking means, for cooperatively latching said second docking means to a length of adjacent drill pipe when said second docking means is not coupled to a locomotive, and for releasing said second docking means from such drill pipe when coupled to a locomotive, (f) a first locomotive having a seal portion with an effective outside diameter substantially equal to the inside diameter of the intended drill pipe and adapted for engaging said first docking means, (g) a second locomotive including means for moving with and being propelled at least in part by said first locomotive, and being movable beneath and independently of said first locomotive, and having a seal portion with an effective outside diameter substantially equal to the inside diameter of said stinger tubing and adapted for pulling a logging cable through the drill pipe, through said first locomotive, and through said tubing, and for coupling to said second docking means, and (h) means below said first docking means for sealing the outside of said stinger tubing movably to the inside of the drill pipe, such that fluid pumped into the drill pipe will propel both locomotives so as to substantially pull the stinger out from the bottom of the drill pipe without buckling said stinger, and retrieval of a cable attached to said second locomotive will retract said stinger back into the drill pipe substantially without buckling said stinger.

2. The apparatus of claim 1 wherein said first docking means receives said first locomotive thereon free from coupling thereto.

3. The apparatus of claim 1 wherein said releasable latching means for said second docking means includes means attachable to substantially the lower end of the drill pipe for latching said second docking means to substantially the bottom end of the drill pipe.

4. A method for performing wireline operations, such as logging and/or perforating, in boreholes penetrating earth formations, comprising:

(a) disposing a length of hollow pipe, such as drill string, in such a borehole, (b) releasably attaching a wireline tool to the bottom of the hollow pipe, the tool being engaged with a hollow extension member subject to movement within the hollow pipe, and (c) moving a locomotive through the pipe to pull a wireline cable to the tool through the pipe and through the hollow extension member to establish electrical and mechanical links between the wireline and the tool, said moving step comprising moving a two-stage locomotive such that the first stage, upon reaching the extension member, engages the upper end of the hollow extension member, and the second stage, following engagement of the downwardly moving first stage with the extension member, continues moving downwardly by moving through the hollow extension member to the tool.

5. The method of claim 4 further comprising the step of substantially pulling the hollow extension member out from the bottom of the hollow pipe by application of fluid pressure on said second stage and the step of retracting the extension member back into the pipe again by pulling on the cable.

6. The method of claim 5 wherein said locomotive moving step comprises the application of fluid pressure through such a pipe.

* * * * *